United States Patent [19]

Funck

[11] 4,274,211

[45] Jun. 23, 1981

[54] SHOE SOLES WITH NON-SLIP PROFILE

[76] Inventor: Herbert Funck, Am Wasserbogen 43, 8032 Gräfelfing-Lochham, Fed. Rep. of Germany

[21] Appl. No.: 25,448

[22] Filed: Mar. 28, 1979

[30] Foreign Application Priority Data

Mar. 31, 1978 [DE] Fed. Rep. of Germany ..... 2813958

[51] Int. Cl.[3] ..... A43B 13/12; A43B 13/18; A43B 13/20; A43C 15/00

[52] U.S. Cl. ..... 36/30 R; 36/3 B; 36/29; 36/32 R; 36/59 C

[58] Field of Search ..... 36/30 R, 32 R, 29, 59 R, 36/59 C, 3 R, 3 B

[56] References Cited

U.S. PATENT DOCUMENTS

| | | | |
|---|---|---|---|
| 2,090,881 | 8/1937 | Wilson | 36/59 C |
| 2,553,616 | 5/1951 | Walls | 36/32 R |
| 3,231,454 | 1/1966 | Williams | 36/3 R |
| 3,533,171 | 10/1970 | Motoki | 36/3 B |
| 4,083,125 | 4/1978 | Benseler et al. | 36/32 R |

FOREIGN PATENT DOCUMENTS

| | | | |
|---|---|---|---|
| 871261 | 5/1953 | Fed. Rep. of Germany | 36/59 C |
| 962584 | 4/1957 | Fed. Rep. of Germany | 36/32 R |
| 1026299 | 2/1953 | France | 36/3 B |
| 1408416 | 7/1965 | France | 36/32 R |
| 16240 | of 1893 | United Kingdom | 36/29 |
| 17099 | of 1901 | United Kingdom | 36/29 |

*Primary Examiner*—James Kee Chi
*Attorney, Agent, or Firm*—Haseltine and Lake

[57] ABSTRACT

The invention relates to a shoe sole made of flexible rubber material with a non-slip profile on the wearing side.

9 Claims, 3 Drawing Figures

SHOE SOLES WITH NON-SLIP PROFILE

DESCRIPTION OF THE INVENTION

Figures 1A, 1B:
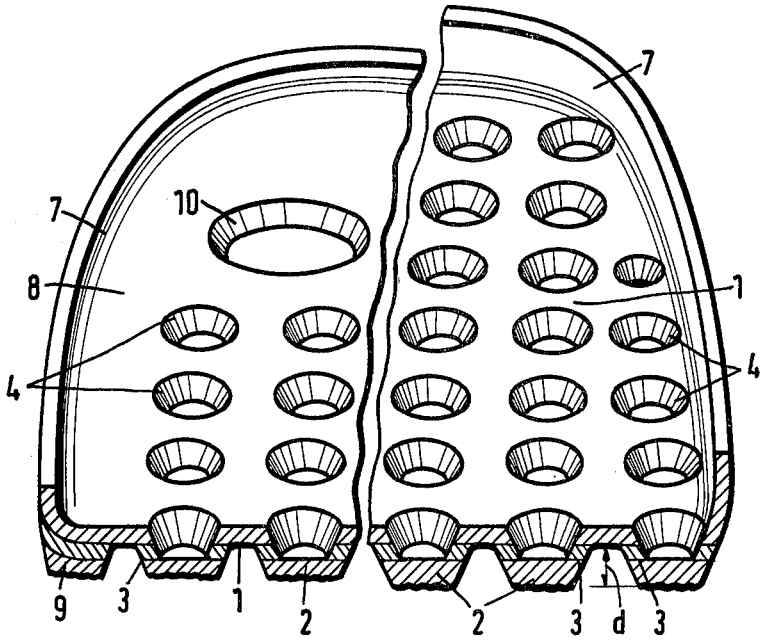

The wearing properties of shoes of the widest range are largely determined by the shaping and characteristics of the shoe soles. In particular with medium and heavy shoes with profiled soles, such as working boots, mountain climbing boots etc., the comparatively high shape stability and the weight of the profiled soles used have a prejudicial effect on the wearing characteristics, because these soles, due to their inherent stiffness are not capable or only inadequately capable of following the natural rolling movements of the foot. With the aim of reducing the weight and providing an improved flexible deformability, soles of a wide range of types have already been developed, where, for example, special, soft and flexible padding pieces have been inserted on the sole inside the shoes or boots. Although such internal padding soles (socks) have become relatively widely distributed, they are nontheless not free of disadvantages. For instance the space required for the "sock" or "internal padding" leads to a certain necessary height of sole and manufacture demands a number of special operations, which necessarily have an impact on production costs.

Another way to ensure favourable flexibility and springing characteristics of shoe soles consists of the use of foam materials for the whole sole, whereby through a suitable foam composition and in particular the foaming operation the flexible deformability of the profiled soles can be set and influenced. Although again this type of sole has its advantages particularly in the case of winter sports shoes and working shoes, such as the extremely simple production of the soles themselves and their connection to the actual shoe, nontheless it is still true that due to the characteristics of the polyurethane which is as a rule used the springing of the soles themselves and their flexibility are not fully satisfactory.

The springing characteristics of shoe soles may also be influenced by the type and shaping of the profiling. Profiled soles are therefore well-known where the profile consists of inverted saw blade-shaped ribs running across the sole. Through the inverted shape of the ribs which have a triangular cross-section, with vertical pressure loading the points of the ribs are pressed into the tooth gaps when the material deforms flexibly. This sole profiling therefore substantially increased the weight and therefore the price of such soles. In addition the inverted or back-cut profile ribs form collecting points for dirt, as a result of which the desired prevention of slipping and also the springing paths are greatly reduced in bad ground conditions.

In addition various versions of highly flexible soles are well-known (i.e. DE-PS No. 1,145,961, DE-GbM Nos. 1,856,907; 7,518,392), where the profile is designed in the form of crossbars and galleries towards the actual shoe and outside contours of the profile side walls slope (i.e. also U.S. Pat. No. 2,580,840). Although these profiled soles have clear advantages compared with soles with a full profile, particularly from the point of view of reducing the weight and increasing flexibility, the deformability and therefore the wearing characteristics have nontheless still not turned out to be satisfactory particularly as regards heavy shoes, such as working shoes or boots.

The task of this invention is to design a shoe sole made of flexible rubber material by design measures that is springy in the surface supporting the ball section of the shoe and at the same time produce a coarse, non-slip wearing profile with a low material consumption rate.

In accordance with this invention this task is solved in that at least the ball section of the sole consists of two flat sole layers of soft flexible deformable sole material, having holes of a preset shape and size, whereby holes in the other sole layer are directed towards the layer elements of one sole layer and the layer elements of both sole layers are connected on all sides by sloping wall sections limiting the holes.

The wearing sole in accordance with this invention therefore represents a stratified unit of greater height than the wall thickness of the separate layers, whereby the individual layer elements themselves have the effect of springing diaphragms, which is even further reinforced by the return spring behaviour of the sloping wall sections.

The improved wearing characteristics aimed at in accordance with this invention are achieved by two measures, which supplement each other in their effects. One measure consists in the special formation of the wall sections, which are extremely flexible. This high degree of flexibility may be achieved by the flat sloping position of the wall and by a suitably short dimensioning of the wall thickness. An optimum degree of deformability and flexibility is obtained when the sloping position and wall thickness of the side walls is selected so that the external layer elements can almost be pressed into the holes of the inside layer elements which means therefore that the side walls themselves cannot be pressed together or can only be pressed together slightly. The second measure resides in the special formation particularly of the bottom layer elements. In accordance with this invention these are large enough so that an effect comparable to that of an elastic or flexible diaphragm occurs.

The spring effect of the diaphragm follows the rolling movement of the foot during walking to a special degree, since the main load in each case is effective only on a small surface area and migrates from the ball of the small toe over the balls of the middle toes to the ball of the inner big toe and from there to the little toe via the middle toes to the big toe. These load concentrations may be absorbed to a special degree by the diaphragm-type spring behaviour of the separate layer elements. Similar effects occur in the event of ground irregularities, such as stones, gravel, plaster etc.

A particularly good distribution of the pressure stresses or loads between the top and bottom layer elements of both sole layers and therefore a good springing with simultaneous formation of a special non-slip sole profiling is achieved in that the bottom layer elements are largely round, diaphragm-type springing disc sections with an additional fine profiling on their bottom wearing surface, whereby holes in the top sole layer are directed towards these disc sections. Likewise largely round and tapering wall sections connect the top layer elements to the bottom layer elements on all sides. A surface ratio of top to bottom sole layer between 1:1 and 2:1 turned out to be particularly good. The thickness of both sole layers may differ depending on the special conditions of utilisation of the corresponding shoes or boots. With safety boots for example a minimum sole thickness of 4 mm is specified, which should be adhered to for both layers the same as for the connecting wall sections. For sports shoes on the other hand it might be a good idea to make the wall thickness of the bottom sole element which is particularly exposed to abrasion thicker than the top sole layer and the connecting wall sections, as a result of which a mild springing and a particularly low weight are achieved. In so doing the vertical distance between the two layers should be between half and three times the wall thickness of the thicker sole layer. On the other hand this ensures the springing of the sole and on the other avoids the bottom disc-shaped layer elements acting like the galleries of, for instance, football shoes.

A special advantage of the new sole construction is its high bending flexibility, brought about by the fact that the two sole layers connected together in each case have holes. These holes also reduce the resistance to longitudinal elongations of the soles. This advantage only comes to full fruition however if the shoe sole is bonded or connected only over an edge zone to the shoe itself. This type of connection maintains the free mobility of the perforated top sole layer and therefore provides good bending flexibility of the sole and the whole shoe. The strength of the connection is particularly good if the edge of the sole is raised, as a result of which the whole sole then has the shape of a flat shell. The perforated top layer may run right up to the outer edge of the shoe, as a result of which the springing characteristics can be utilised on the whole surface of the sole. In this case the sole is simply bonded to the top shoe with its largely vertically raised edge section. If the connecting surface is not sufficient to achieve the necessary strength, then the horizontal section of the top sole layer a continuous edge zone extends without holes. The additional result of this is also that the then compacted wearing surface sections under this edge zone can transfer the pressure required when bonding perfectly to the connecting zone.

With the shoe sole in accordance with this invention at the preselected points for a specific type of shoe or boot a greater mildness of springing can be achieved which, for instance, with safety shoes is a good thing at the point of the shoe underneath the steel cap. Here a gentle through-swinging of the shoe itselft when there is an impact or blow on the steel cap guarantees greater freedom of the toes inside the shoe or boot and therefore less danger to the wearer. This softer springing characteristic may be achieved by increasing the holes of the top sole layer and therefore through a corresponding increase in the layer elements of the bottom sole layer. A similar effect is brought about by reducing the intermediate distance of both sole layers at these preselected points. Through the optionally combined use of the aforementioned measures the springing characteristics of the shoe soles may be simply matched by design to the widest range of requirements in the ball area.

With safety shoes or boots in Germany it is specified that protection against slipping must be guaranteed by a minimum wearing profile height in addition to the thickness of the sole. This protection against slipping naturally only exists as long as the wearing profile sections project beyond the bottom surface of the sole. As soon as these have worn down, which above all may happen at the highly stressed points such as underneath the outer and inner balls of the foot, the shoe loses its protection against slipping and becomes dangerous to the wearer. However from experience we know that shoes of this kind continue to be worn for a long time, since the thickness of the sole with standard soles still exists additionally to the wearing profile galleries.

Until this sole thickness has also worn down and the shoe can no longer be worn due to water penetrating, there may be a very long time, during which the wearer is at risk since his shoes are no longer protected against slipping and sliding.

In this case the new sole may provide a remedy, if the holes of the top layer, at least at the highly stressed outer and inner balls of the sole are at least as deep as the top layer is thick.

With this formation, at least at the highly stressed points, water will get into the shoe and the latter will therefore no longer be wearable, if the bottom layer elements have worn down. There then occurs a hole in the sole. There is therefore a king of "self-monitoring" by "theoretic destruction" in the case of the sole, as soon as protection against slipping no longer exists at the most important points. This self-monitoring is not restricted to the new sole, but may also be applied with standard safety boot soles. For this purpose provision is made, from the top of the sole above the centre of the wearing profile galleries guaranteeing protection against slipping, principally the most stressed points under the outer or inner balls, of small blind holes or narrow grooves, which are open upwards, the depth of which corresponds at least to the basic thickness of the sole. Soles such as these also let water in and therefore become unwearable as soon as the profile galleries have completely been worn away. If the parts of these blind holes or grooves are greater than the wall thickness of the basic surface of the sole, the sole lets water in and therefore becomes unwearable, before the galleries have been completely worn away—therefore the protection against slipping has not been completely lost.

Figure 2:
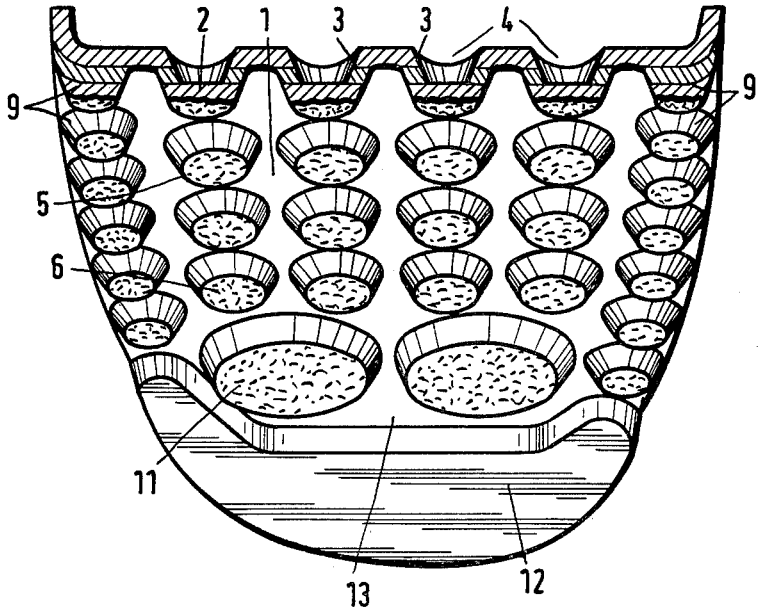

Embodiments of the shoe sole according to this invention are explained in detail below on the basis of the drawings. The drawings are as follows:

FIG. 1*a*, 1*b* two sole versions in a plan perspective view,

FIG. 2. a plan view from underneath the version in FIG. 1*a*.

The ball sections of the shoe sole according to this invention which are shown and which are made of soft flexible material consist of a top perforated sole layer 1 and a bottom, also perforated, sole layer 2. Sloping wall sections 3 connect the two sole layers and at the same time limit the holes formed as round holes 4 in the top layer. The bottom layer 2 consists of a multiplicity of disc-shaped layer elements 5, the bottom wearing surface of which has a fine profiling 6. To the side outside holes 4 in the top layer in the version according to FIG. 1*a* a continuous, substantially horizontal edge zone 8 is formed, which transfers into a raised sole edge 7. In the case of the version according to FIG. 1*b* there is no horizontal section of the connecting zone 8, whereby at the same time the sole edge which extends substantially vertically is lengthened, in order to provide an adequate connecting surface.

The version according to FIGS. 1*a* and 2 is a sole for working boots and has in its toe area a continuous section 12, to which a row of compact edge galleries 9 are connected. Immediately behind this section 12 the top layer holes 10 of a larger circular area are provided, towards which correspondingly large disc elements 11 in the bottom layer are directed. The distance d between the two disc-shaped layer elements 11 and the corresponding elements 13 of the upper sole layer ist less than that between the two sole layers 1 and 2 in the remaining ball area, that is to say the height of the two discs 11 shown is less than that of discs 5.

FIG. 1*b* shows that the wall thickness between the layer elements of the top sole layer 1 and those of bottom sole layer 2 may differ. With mechanically highly stressed shoe soles, i.e. for working shoe uppers, it is necessary to design the disc-shaped elements of bottom layer 2 thicker than those of top sole layer 1.

The shoe sole shown cannot, despite a certain similarity of shape, be compared with, for instance, integrally cast gallery soles for, i.e. football shoes. Such gallery soles have in the first place the task of providing the wearer with a safe and reliable hold in deep ground. Due to the shaping and the material of the galleries none of these and therefore none of the, sole can provide a continuous spring action, which is what is aimed at in the case of the shoe sole in accordance with this invention.

I claim:

1. Shoe soles made of flexible rubber material with non-slip profiling on the wearing side, comprising: at least a section of the shoe sole which covers the ball of the foot having two largely flat sole layers of soft flexible deformable sole material, said sole layers having holes of a preset shape and size and which remain open, layer elements of a bottom layer of the sole being directed towards said holes in the top layer of the sole, layer elements of both layers of the sole being connected integrally on all sides by sloping wall sections limiting the holes, both of said sole layers providing resilience to the sole, parts forming the lower layer with holes being relatively wide.

2. Shoe soles made of flexible rubber material with non-slip profiling on the wearing side, comprising: at least a section of the shoe sole which covers the ball of the foot having two largely flat sole layers of soft flexible deformable sole material, said sole layers having holes of a preset shape and size and which remain open, layer elements of a bottom layer of the sole being directed towards said holes in the top layer of the sole, layer elements of both layers of the sole being connected integrally on all sides by sloping wall sections limiting the holes, is at least twice as great as the distance between the two layers of the sole.

3. Shoe sole in accordance with claim 2, wherein the bottom layer elements are largely round, membrane-type springy sections with an additional profiling on their bottom wearing surface to which largely round holes in the top, diaphragm-type spring layer of the sole are directed, the connecting wall sections being tapered.

4. Shoe sole in accordance with claim 2 wherein the wall thickness of both layers of the sole is different.

5. Shoe sole in accordance with claim 2 wherein the vertical distance of both layers of the sole is between at least half and at most three times the thicker layer of the sole.

6. Shoe sole in accordance with claim 2, wherein the top layer of the sole has a continuous edge zone for connecting only the sole to the shoe.

7. Shoe sole in accordance with claim 4, wherein an edge zone is raised as a shell to form the edge of the sole along the side.

8. Shoe sole in accordance with claim 2, wherein the size of the bottom layer elements and their distance from the top layer elements differs.

9. Shoe sole in accordance with claim 2, wherein at least one of the bottom layer elements in the inner or outer ball zone specially exposed to wear has a lesser wall thickness than the distance between the two layers.

* * * * *